United States Patent [19]

Cook

[11] 3,978,866

[45] Sept. 7, 1976

[54] SMOKING COMPOSITIONS

[75] Inventor: Lawrence C. Cook, Winston-Salem, N.C.

[73] Assignee: R. J. Reynolds Tobacco Company, Winston-Salem, N.C.

[22] Filed: Sept. 3, 1974

[21] Appl. No.: 502,601

[52] U.S. Cl. ..... 131/2; 131/17 R

[51] Int. Cl.[2] ..... A24B 15/00

[58] Field of Search ..... 131/2, 17 R, 17 AC, 131/15, 140–144, 20, 58, 1

[56] References Cited

UNITED STATES PATENTS

| | | | |
|---|---|---|---|
| 3,100,492 | 8/1963 | Schmidt | 131/2 |
| 3,638,660 | 2/1972 | Davis | 131/2 |
| 3,796,222 | 3/1974 | Deszyck | 131/17 R X |

FOREIGN PATENTS OR APPLICATIONS

| | | | |
|---|---|---|---|
| 687,507 | 3/1967 | Belgium | 131/2 |
| 1,113,979 | 5/1968 | United Kingdom | 131/2 |

OTHER PUBLICATIONS

"The Chemical Comp. of Tob. & Tob. Smoke" by Stedman p. 190 Eastern Utiliz. Res. and Dev. Div. Res. Service USDA Penn. 19118 reviewed 10/18/67.

Shmuk; vol. 3 of "The Chem. & Tech. of Tob." pp. 602–603 pub. by Pischepromizdat Moscow 1953.

"Dangerous Prop. of Indust. Material" by Sax, 3rd Edition (p. 461) 1968, Reinhold Publ. Co.

"Production Peanuts Processing Products" p. 254, by Woodroof, Copyright 1966.

*Primary Examiner*—Robert W. Michell
*Assistant Examiner*—V. Millin
*Attorney, Agent, or Firm*—Neuman, Williams, Anderson & Olson

[57] ABSTRACT

Peanut shells are used with or without tobacco to provide smoking materials.

8 Claims, No Drawings

SMOKING COMPOSITIONS

This invention relates to novel smoking compositions and to products derived therefrom.

It is a principal object of this invention to provide a composition of matter which is advantageous for use as a smoking material.

It is another object of this invention to provide novel compositions containing tobacco which compositions can be used to form products such as cigarettes, cigars, pipe tobacco and the like.

The present invention involves the discovery that peanut shells (i.e., peanut hulls) are eminently suitable for use as a smoking material.

In one embodiment, the invention provides smokable compositions comprising a mixture of tobacco and comminuted peanut shells. The peanut shell material serves as a tobacco extender without significant effect on the organoleptic properties of tobacco products in which it is present. In a second embodiment of the invention, peanut shells are used alone or with other non-tobacco materials to form smoking materials.

Peanut shells are a waste product of the peanut industry and are inexpensive and plentiful in supply. For use in accordance with this invention, the peanut shells are used in a comminuted form. It is generally preferred to grind, or more preferably shred, or otherwise comminute the peanut shell material to a size and shape approximating that of the tobacco with which it is employed. Thus, when employed with tobacco to form cigarettes, the peanut shell material is cut, sliced or shredded to a size and shape similar to the filler tobacco employed therewith. It is preferred to do likewise when the peanut shell extender is used with tobacco to form cigars or pipe smoking compositions.

When used with tobacco, the peanut shell extender is blended with tobacco and the blend is then processed in conventional manner to form tobacco products. For example, peanut shells are shredded to a size approximating that of cut filler tobacco and blended therewith in desired proportion. The blend is then processed in conventional cigarette-making machines to form cigarettes which can be either of the filter or non-filter type. Conventional additive materials known to the art, such as flavorants, humectants, ash improvers, combustion modifiers, fillers and the like can be incorporated with the tobacco/peanut shell blends. Pipe or smoking tobacco products can be readily produced by simply blending comminuted peanut shells with tobacco and flavorants, if any.

It will be appreciated that the use of peanut shells with tobacco serves to extend the tobacco or reduce the amount of tobacco employed in a product with a concommitant decrease in the amount of nicotine therein. This desideratum is achieved without adverse effect on the taste or aroma of the final product. The amount of the peanut shell extender which is blended with the tobacco can vary widely from about 1 to 50% or more by weight of the tobacco. For cigarettes, it is generally preferably, however, that the peanut shell material be used in an amount ranging from about 1 to 25% by weight of the tobacco.

According to a second embodiment of the invention, peanut shells are used alone as a tobacco substitute or with other non-tobacco materials to form smoking products such as cigarettes, cigars and pipe smoking products. A presently preferred procedure according to this embodiment is to form a sheet of comminuted peanut shells following procedures well known for making reconstituted tobacco sheets. Thus, disintegrated or comminuted peanut shells are prepared by grinding or milling the same to a fine powder-like form either dry or in the presence of an aqueous liquid material. Binding agents such as carboxymethylcellulose, starch or other suitable adhesive materials are incorporated to enable the product to be rolled out to form a flat sheet which can then be dried to a desired moisture content. Other known procedures for forming reconstituted tobacco sheets can also be employed to form a sheet containing the peanut shell materials. Such procedures include known paper-making processes or the use of a film-forming material cast on a base web onto which peanut shell particles can be cast.

The burning rate, flavor and other properties of non-tobacco smoking products can be altered by incorporating with the peanut shells suitable additives well known to the art, such as flavorants, tobacco extracts, nicotine, humectants, ash improving additives, etc. To decrease the burning rate of non-tobacco smoking products, suitable filler materials or combustion modifiers such as sodium chloride, ammonium dihydrogen phosphate, calcium oxalate, magnesium oxalate, potassium carbonate, sodium carbonate, calcium carbonate and the like can be incorporated with the peanut shell material. The materials which are used with the peanut shells to form smoking products are employed in amounts depending upon the effects desired.

When used with or without tobacco to form smoking materials, the peanut shells or sheets prepared therefrom are preferably conditioned to a moisture content of say from 6 to 15% at which moisture content the material is well adapted for processing to form smoking products. At a moisture content below about 4%, these materials tend to be somewhat friable and less suitable for processing.

In a particularly preferred embodiment of this invention, peanut shells are comminuted and then are subjected to a refining operation to remove dense, hard particles from the comminuted mass of material prior to formation of a reconstituted sheet. These hard particles detract from the quality of the sheet prepared from the peanut shell pulp and are, therefore, preferably removed. A convenient method for removing the dense, hard particles from the comminuted shells is to decant from a liquid medium in such a way that the fibrous material is decanted from the heavier, hard particles which tend to settle quickly to the bottom of the liquid medium. For example, peanut shells are placed in sufficient liquid such as water to permit the high speed blending thereof for approximately 20 minutes. The resulting pulp slurry is diluted with more liquid if necessary and is then allowed to sit undisturbed for a short period of time. The dense, hard particles settle quickly to the bottom thereby allowing the remainder of the slurry to be carefully decanted and further processed into sheets.

While comminuted peanut shells can be used directly in the manufacture of smoking products, the use of peanut shells in the form of reconstituted sheets gives a greater degree of control over the smoking quality of peanut shell material. Such control includes not only the selective removal of certain portions of the comminuted peanut shells as described above, but also a more uniform distribution of combustion modifiers throughout the material.

The formation of sheets from peanut shells can be accomplished using conventional sheet-making techniques. In general, this involves the preparation of an aqueous pulp slurry which is then cast onto a porous support and pressed to remove excess water. Desired combustion modifiers or other additives may be applied to the sheet prior to drying and subsequent processing into smoking products. It is preferred that the pulp slurry used for casting the sheet contain approximately 3 to 5% by weight solids. It has also been found that the strength and quality of the resulting sheet is significantly improved by incorporating minor quantities of α-cellulose into the pulp slurry. Thickness of the sheets will vary somwehat but sheets weighing about 4 to 6 grams per square foot at 10 to 15% moisture are suitable for use in making smoking products.

The following examples illustrate the advantages of the present invention.

EXAMPLE 1

Spanish peanut hulls (300 grams) in 7 liters of water were blended for 1.0 hour in a Noble and Wood cycle beater and the resulting pulp was made into sheets on a Noble and Wood 12-inch × 12-inch sheet machine. The sheets were dried and then shredded on a Michael paper shredder (⅛ inch cut) and mixed with varying proportions of a commercial tobacco blend. Cigarettes were hand-rolled from each blend and submitted for smoke analysis. Results are shown in Table I.

TABLE I

| Analysis[a] | Percent Peanut Hulls in Peanut Hulls:Tobacco Blend | | | | |
|---|---|---|---|---|---|
| | 0 | 25 | 50 | 75 | 100 |
| Weight[b], g. | 0.79 | 0.75 | 0.75 | 0.76 | 0.78 |
| Pressure Drop, in. of water | 0.88 | 1.24 | 1.18 | 2.70 | 3.96 |
| TPM[c], wet, mg. | 37.1 | 29.2 | 23.5 | 18.7 | 11.0 |
| TPM[c], dry, mg. | 29.8 | 25.1 | 20.6 | 16.3 | 9.9 |
| Nicotine[d], mg. | 1.75 | 1.18 | 0.75 | 0.35 | 0 |
| Puffs | 8.0 | 8.6 | 8.1 | 9.5 | 10.4 |

[a]Analysis are per 70-mm. cigarette, smoked to a 23-mm. butt under standard smoking conditions (i.e., one 35-ml. puff of 2-second duration each minute).
[b]Includes weight of paper and filler rod.
[c]Total Particulate Matter.
[d]As determined by standard procedure of Federal Trade Commission.

EXAMPLE 2

Peanut hulls were extracted with 1.2 and 2.4 N aqueous hyrochloric acid solutions and also with a 1.2 N aqueous sulfuric acid solution to remove hemicelluloses from the hulls. The peanut hulls used in these extractions were Valencia for the dilute hydrochloric acid treatment and Spanish for the dilute sulfuric acid treatment. In a typical extraction, 60 grams of Valencia peanut shells were heated at 70°–80° F. for 3.0 hours in a 4000-milliliter beaker with 2500 milliliters of distilled water and 300 milliliters of 37% hydrochloric acid. The acid solution was decanted, and treated shells were washed three times with 3000 milliliters of distilled water. The washed shells were then blended in a Waring Model CB-5 blender at low speed for 45 minutes. Sheets were cast from the resulting slurry in a manner similar to that described in Example 1. These sheets were more flexible and less dusty than those from untreated hulls. The dried sheets were fabricated into test cigarettes and submitted for smoke analysis. Table II shows these data.

Fifty grams of the sulfuric acid-treated Spanish peanut hull sheets were sprayed with 100 milliliters of an aqueous solution containing 5.0 grams of potassium carbonate and 0.5 gram of ammonium oxalate. After drying, these sheets were sprayed with 25 milliliters of a commercial cigarette casing, re-dried, and fabricated into cigarettes. Evaluation by expert smokers indicated that these cigarettes exhibited increased mildness over cigarettes prepared from untreated Spanish peanut hull sheets.

TABLE II

SMOKE ANALYSIS OF ACID-TREATED PEANUT HULL CIGARETTES

| Analysis[a] | Extraction of Valencia Hulls With Hydrochloric Acid | | Extraction of Spanish Hulls With Sulfuric Acid |
|---|---|---|---|
| | 1.2 N | 2.4 N | 1.2 N |
| Weight[b], g. | 0.70 | 0.70 | 1.00 |
| Pressure Drop Range in. of water | 2–4 | 2–4 | 2–4 |
| TPM[c], wet, mg. | 7.8 | 9.6 | 6.8 |
| TPM[c], dry, mg. | 7.0 | 8.8 | 6.2 |
| Puffs | 9.6 | 9.9 | 5.6 |

[a]Analyses are per 70-mm. cigarette smoked to a 23-mm. butt under standard smoking conditions (i.e., one 35-ml. puff of 2-second duration each minute).
[b]Weight includes the weight of paper.
[c]Total Particulate Matter.

EXAMPLE 3

Spanish peanut hulls (100 g.) were blended in 1200 milliliters of water at 19,600 RPM for 20 minutes, poured into a beaker containing 4000 milliliters of water, and allowed to settle for about one minute. The supernatant pulp slurry was decanted carefully in order not to disturb any of the heavier particles which had settled to the bottom. These heavier particles were discarded. To the suspended peanut hull pulp was added pulped α-cellulose (1.5 g.) and sheets were cast. Total weight of these sheets after drying was 33.7 grams; an average sheet weighed 6.3 grams. They were relatively flexible and non-dusty. Cigarettes were made from these sheets by blending 10% by weight of the peanut hull sheets with a commercial tobacco blend. Expert smokers were unable to detect any significant differences in the smoking quality of these cigarettes when compared with a control cigarette containing tobacco only.

When cigarettes were made exclusively from these peanut hull sheets, flame-ups during smoking precluded all but subjective analysis. For this reason, the decanted hull sheets were sprayed with 67 milliliters of an aqueous solution containing 4 milligrams per milliliter of ammonium carbonate, 1 milligram per milliliter of potassium acid phosphate, 0.6 milligram per milliliter of potassium tartrate, 0.6 milligram per milliliter of potassium carbonate, 1.5 milligrams per milliliter of ammonium hydroxide and 10 milligrams per milliliter of nicotine. The treated sheets were dried and shredded, then hand-rolled into cigarettes and submitted for smoke analysis. These results are shown in Table III.

TABLE III

SMOKE ANALYSIS FOR CIGARETTES CONTAINING DECANTED PEANUT HULLS PLUS 5% α-CELLULOSE

| Analysis[a] | Value |
|---|---|
| Weight[b], g. | 0.67 |

TABLE III-continued

SMOKE ANALYSIS FOR CIGARETTES CONTAINING DECANTED PEANUT HULLS PLUS 5% α-CELLULOSE

| Analysis[a] | Value |
|---|---|
| Pressure Drop, in. of water. | 2.6 |
| TPM[c], wet, mg. | 19.1 |
| TPM[c], dry, mg. | 16.4 |
| Puffs | 5.0 |

[a]Analyses are per 70-mm. cigarette smoked to a 23-mm. butt under standard smoking conditions (i.e., one 35-ml. puff of 2-second duration each minute).
[b]Weight includes the weight of paper.
[c]Total Particulate Matter.

EXAMPLE 4

Five grams of Valencia peanut shells and 0.25 gram of α-cellulose (No. 7768 Celate Pulp obtained from Ecusta Paper Co.) were blended in 300 milliliters of water for 2 minutes at 22,000 RPM using a Waring blender. The resulting slurry was made into sheets by pouring into a Buchner funnel fitted with an 80-mesh stainless steel screen covered with filter paper. Excess water was removed by vacuum applied to the Buchner funnel. The sheets were dried, cut into 1 × 1/16-inch strips, and made into cigarettes using a TOP hand-rolling cigarette machine and gummed cigarette paper. Cigarettes fabricated in this manner were machine-smoked and data relating thereto were obtained as shown in Table IV.

TABLE IV

| Analysis[a] | Value |
|---|---|
| Weight[b], g. | 0.60 |
| Pressure Drop Range, in. of water. | 3–4.5 |
| TPM[c], dry, mg. | 5.6 |
| Puffs | 6.32 |

[a]Analyses are per 70-mm. cigarette smoked to a 23-mm. butt under standard smoking conditions (i.e., one 35-ml. puff of 2-second duration each minute).
[b]Weight includes the weight of paper.
[c]Total Particulate Matter.

EXAMPLE 5

Peanut shells were placed in a Soxhlet apparatus and extracted for 2 hours with methanol and for 2 hours with water. The extracted shells were then pulped, were made into sheets, and were then fabricated into cigarettes by the procedure given in Example 4. These cigarettes, containing extracted peanut shells in combination with 5% by weight α-cellulose, were machine-smoked and data relating thereto are shown in Table V.

TABLE V

| Analysis[a] | Value |
|---|---|
| Weight[b], g. | 0.60 |
| Pressure Drop Range, in. of water. | 3–4.5 |
| TPM[c], dry, mg. | 11.4 |
| Puffs | 6.09 |

[a]Analyses are per 70-mm. cigarette smoked to a 23-mm. butt under standard smoking conditions (i.e., one 35-ml. puff of 2-second duration each minute).
[b]Weight includes the weight of paper.
[c]Total Particulate Matter.

EXAMPLE 6

Sheets prepared in accordance with Example 4 were treated with a commercial cigarette casing material at concentrations equaling 5%, 10% and 20% of the smoking material weight. A portion of the smoking material was also saturated with the casing material by dipping the strips into the casing and removing the excess by blotting.

The making and burning properties of cigarettes fabricated from the treated material improved as the concentration of the casing increased.

The taste and aroma of smoke from cigarettes made from the cased sheets were evaluated by expert smokers and were deemed to be much improved over those of the smoke from cigarettes prepared from untreated sheets.

EXAMPLE 7

Aqueous 2% solutions of potato starch, cationic potato starch, or highly substituted hydroxyethyl corn starch were added at a level of 5% of the sheet weight to the surface of sheets prepared in accordance with Example 4. The sheets were allowed to dry and they were then cut and made into cigarettes.

Temperature and burning rate studies were performed on cigarettes fabricated from these smoking materials and the results are recorded in Table VI.

Evaluation by expert smokers of the smoking properties and of the taste and aroma of the smoke from these cigarettes indicates that the burning properties are not noticeably altered and no difference is detectable in the taste and aroma of the smoke when compared with cigarettes prepared from untreated sheets. The treated sheets, however, were found to have increased physical strength and stiffness which were beneficial to the cigarette making properties thereof.

TABLE VI

TEMPERATURE STUDIES ON CIGARETTES CONTAINING PEANUT SHELL:5% α-CELLULOSE SMOKING MATERIAL WITH 5% FILM-FORMING STARCHES AND CASING ADDED[a]

| Type of Additive[b] | Thermocouple Distance, cm.[c] | Max. Temp. During Puff, °C.[d] | Smoulder Temp., °C.[e] | Total No. of Puffs | Burning Rate Sec./cm. | Burning Rate Mm./puff | Max. Cone Lgth., mm. | Pressure Drop Range, in. |
|---|---|---|---|---|---|---|---|---|
| Potato Starch | 3 | 961.3 | 752.3 | 9 | 101.9 | 1.2 | 7 | 2.8–3.2 |
| Cationic Potato Starch | 3 | 906.3 | 759.7 | 9 | 110.8 | 1.3 | 7 | 4.3–6.0 |
| Highly Substituted Hydroxyethyl | | | | | | | | |

TABLE VI-continued

TEMPERATURE STUDIES ON CIGARETTES CONTAINING PEANUT SHELL:5% α-CELLULOSE SMOKING MATERIAL WITH 5% FILM-FORMING STARCHES AND CASING ADDED[a]

| Type of Additive[b] | Thermo-couple Distance, cm.[c] | Max. Temp. During Puff, °C.[d] | Smoulder Temp., °C.[e] | Total No. of Puffs | Burning Rate Sec./cm. | Burning Rate Mm./puff | Max. Cone Lgth., mm. | Pressure Drop Range, in. |
|---|---|---|---|---|---|---|---|---|
| Corn Starch | 3 | 929.3 | 757.0 | 9 | 104.0 | 1.2 | 7 | 2.7-4.2 |

[a]Each cigarette contained 750 mg. of smoking material and the values in the table represent an average of 3 cigarettes.
[b]Each starch was added at a concentration equaling 5% of the weight of the smoking material. The cased cigarettes had been saturated with casing material used in a commercial cigarette.
[c]The thermocouple was made of platinum:platinum-rhodium. The maximum temperature during the puff was recorded on a Leeds and Northrup Speedomax Recorder.
[d]Cigarettes were smoked on an automatic smoking machine standardized to take a 35-ml. puff of 2-second duration per minute.
[e]Cigarettes were allowed to burn through a platinum:platinum-rhodium thermocouple without puffing and the maximum temperature was recorded on a Leeds and Northrup Speedomax Recorder.

EXAMPLE 8

Peanut shells were soaked in warm water for one hour prior to shredding them with a guillotine-type cutter capable of 32 cuts per inch. The shredded peanut shells were then dried to about 12.5% moisture, blended with a commercial tobacco blend at levels of 5, 10 and 15% by weight of the total blend and the resulting blend was made into cigarettes. Evaluation of these cigarettes by expert smokers was carried out by comparing them with control cigarettes containing all tobacco.

| Peanut Hull:Tobacco Ratio (by weight) | Evaluation |
|---|---|
| 5:95 | Some of the smokers detected no difference from the control. Those who did detected a very slight woody note reminiscent of tobacco stems. |
| 10:90 | All smokers detected a woody note suggestive of tobacco stems but found the test cigarette to be acceptable. |
| 15:85 | All smokers regarded the product to be acceptable but noted increased harshness over the control cigarette. |

The use of peanut shells with tobacco to produce useful products possesses numerous advantages. Thus, use thereof permits a significant reduction in the utilization of tobacco. Not only is the use of less tobacco in a tobacco product obviously advantageous from an economic standpoint, but the reduction of nicotine in such products may be highly desirable. The peanut shells are easily processed and readily available at low cost, and eminently satisfactory smoking products can be produced therefrom.

Those modifications and equivalents which fall within the spirit of the invention are to be considered a part thereof.

What is claimed is:

1. A smoking material which contains comminuted peanut shells in combination with tobacco or a flavorant additive, said peanut shells being in a form resembling cut cigarette filler tobacco or cut pipe tobacco.

2. A smoking material in accordance with claim 1 which contains tobacco and said peanut shells.

3. A cigarette having a filler which contains comminuted peanut shells in combination with tobacco or a flavorant additive, said peanut shells being in a form resembling cut cigarette filler tobacco.

4. A cigarette in accordance with claim 3 wherein the filler contains tobacco and said peanut shells.

5. A process of preparing a cigarette which comprises wrapping with a cigarette paper a filler material containing comminuted peanut shells in combination with tobacco or a flavorant additive, said peanut shells being in a form resembling cut cigarette filler tobacco.

6. A process in accordance with claim 5 wherein said filler contains tobacco and said peanut shells.

7. A process of preparing a smoking material which comprises forming a sheet from peanut shells, drying the sheet and comminuting the dried sheet into small parts resembling cut cigarette filler tobacco or cut pipe tobacco.

8. A process of preparing a cigarette which comprises forming a sheet from peanut shells, drying the sheet, comminuting the dried sheet into comminuted particles resembling cut cigarette filler tobacco and wrapping with a cigarette paper the said comminuted peanut shells in combination with tobacco or a flavorant additive.

* * * * *